US005524889A

United States Patent [19]

Rush

[11] Patent Number: 5,524,889

[45] Date of Patent: Jun. 11, 1996

[54] PUTTER HAVING GOLF BALL APERTURE AND RETAINING ELEMENT

[76] Inventor: Robert Rush, 1559 Breese St. NE., Palm Bay, Fla. 32905

[21] Appl. No.: 396,571

[22] Filed: Mar. 1, 1995

[51] Int. Cl.[6] ..... A63B 53/04

[52] U.S. Cl. ..... 473/286; 294/19.2

[58] Field of Search ..... 273/162 E; 294/19.2

[56] References Cited

U.S. PATENT DOCUMENTS

| | | | |
|---|---|---|---|
| 1,960,110 | 5/1934 | Iles | 273/162 E |
| 3,708,172 | 1/1973 | Rango | 273/162 E X |
| 4,976,436 | 12/1990 | Serizawa | 273/162 E |
| 5,299,846 | 4/1994 | Rush | 273/162 E X |

*Primary Examiner*—William H. Grieb
*Attorney, Agent, or Firm*—Charles E. Wands

[57] ABSTRACT

A golf club, in particular, a putter, having a golf ball-seizure device integrated into the putter head. The putter head has a golf ball-seizing aperture. The aperture has an effective interior diameter that allows passage of a golf ball therethrough by relative flexible movement between an interior surface of the aperture and an outer surface of the golf ball. For this purpose, a flexible ring may be installed in the aperture. A retaining element is mounted adjacent to the aperture such that a golf ball, upon passing upwardly through the aperture, is restricted from further substantial movement and thereby captured in a confinement volume by the combination of the effective interior diameter of the aperture and the retaining element.

16 Claims, 4 Drawing Sheets

PUTTER HAVING GOLF BALL APERTURE AND RETAINING ELEMENT

FIELD OF THE INVENTION

The present invention in general to golf equipment, and is particularly directed to a new and improved putter head configuration which incorporates a golf ball seizing aperture and an associated retaining element, that readily enable a golf ball to be retrieved from a golf playing surface, such as a putting green, without the golfer having to bend over and grasp the ball by hand.

BACKGROUND OF THE INVENTION

In my previously issued U.S. Pat. No. 5,299,846, entitled: "Golf Club Ball Extractors," I describe a golf ball retrieval device that is fitted to the handle-grip end of a golf club, such as a putter, and which facilitates a golfer's seizure of a golf ball from the golf playing surface, without requiring the golfer to bend over and grasp the ball by hand. As pointed out in that patent, although physically bending over is customarily not a problem for a younger player, it may be strenuous and extremely difficult, if not an effectively impossible task, for an elderly person, someone with a back problem, arthritis, or a handicapped individual.

As diagrammatically illustrated at 1 in FIG. 1, the cylindrically shaped module of the invention described in my above-referenced patent is sized to be fitted to the hand-grip region 2 of a golf club 3, and is configured so that it may encompass and hold a golf ball, when the golf club is inverted and pressed downward on the ball. The module is provided with at least one hole 4 through its sidewall, so that the golfer may insert a finger through the hole and push the seized ball outwardly, thereby removing the captured ball from the device.

Now although my patented device provides the golfer, particularly an individual having limited physical ability, with a grip-mounted device that eliminates the need to bend over when retrieving a ball, I have concluded that it would be desirable to integrate the ball-seizure functionality of the device directly into the club head, without requiring the golfer to invert the club and then grasp the club in the vicinity of the club head, so that the handle-mounted device can be pressed down onto the ball. Indeed, it would be particularly useful if the golfer were able to grip a club, such as a putter, by its handle and retrieve the golf ball by means of the putter head.

SUMMARY OF THE INVENTION

Pursuant to the present invention, I have provided a further enhancement to a golf club, that incorporates ball-seizure functionality similar to that employed in my patented handle-mounted device, by modifying the head of a golf club, such as a putter head, so that the golf club head itself includes a golf ball seizing aperture. Cooperating with the aperture is an associated retaining element, such as a tine, finger, or ring, mounted adjacent to the aperture, that readily enables a golf ball to be easily retrieved and captured at the club head, simply by the golfer holding the club by its handle, rather than inverting the club.

In a non-limiting example, the putter head may have a generally flat surfaced base that extends generally horizontally from and is solid with a generally vertical body portion that forms the putting face of the club. A shaft attachment shank is integrally formed with the vertical body portion and is configured to be mounted to the lower end of the putter shaft. Extending between top and bottom flat surfaces of the base is a generally cylindrically shaped aperture, the interior wall portion of which is contoured to receive and capture a flexible ring of elastically deformable material. This flexible ring has an inner diameter that is slightly smaller than that of a golf ball, so that the ring must flex slightly in order to allow a golf ball to pass through it. Once the golf ball passes through the ring, the ring returns to its original diameter and serves to provide a stop for the ball.

A further ball movement restriction or retaining element, which may be in the form of a semicircular ring, or the like, is affixed to the top surface of the putter head base, so as to extend over the aperture. This retaining ring is shaped and sized to encompass a golf ball capture or confinement volume above the aperture in the putter head base, that is sufficient to allow a golf ball to pass through the aperture, but then be restricted from further substantial movement and thereby captured in the confinement volume by the combination of the reduced inner diameter of the flexible ring and the retaining element.

To remove the ball from this captured condition, the golfer may use one or more fingers to simply push downward on the ball from the top side of the putter head base, thus forcing the flexible ring to expand slightly, and thereby allow the ball to pass through the aperture to the bottom surface of the base and into the golfer's hand.

DETAILED DESCRIPTION

Figure 2:
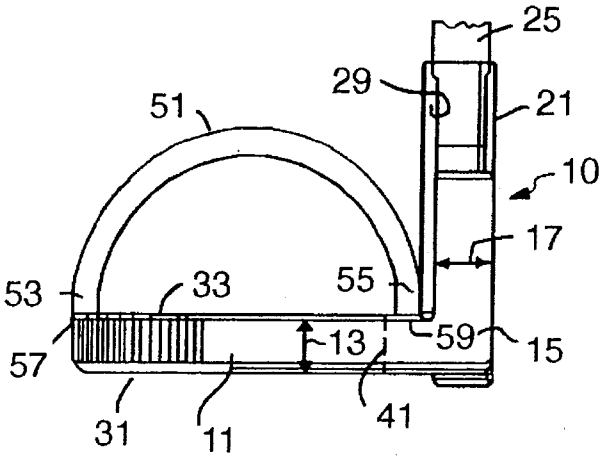
FIG. 2 is a diagrammatic side view of a putter head that has been fitted with the golf ball extracting device of the present invention.
Figure 3:
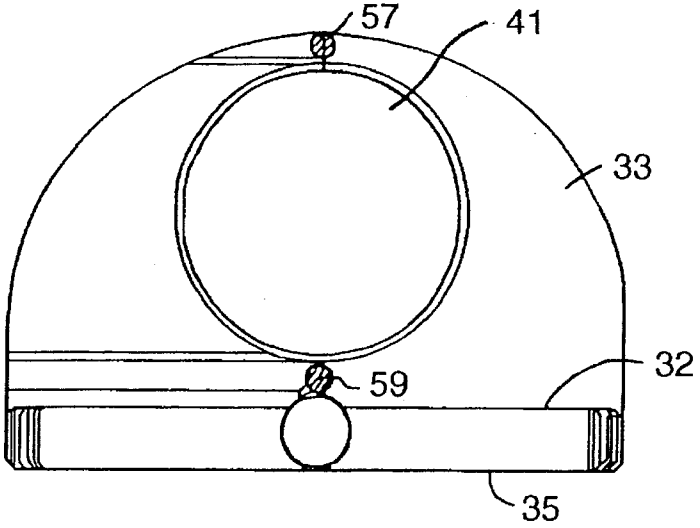
FIG. 3 is a diagrammatic top view of the putter head of FIG. 2.
Figure 1:
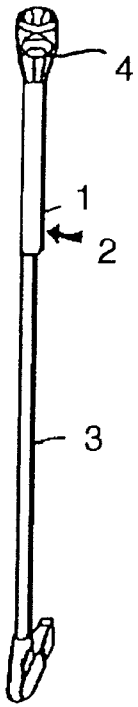
FIGURE 1 (PRIOR ART)
FIG. 1 diagrammatically illustrates the cylindrically shaped, golf ball retrieving module of the invention described in my above-referenced patent.
Figure 4:
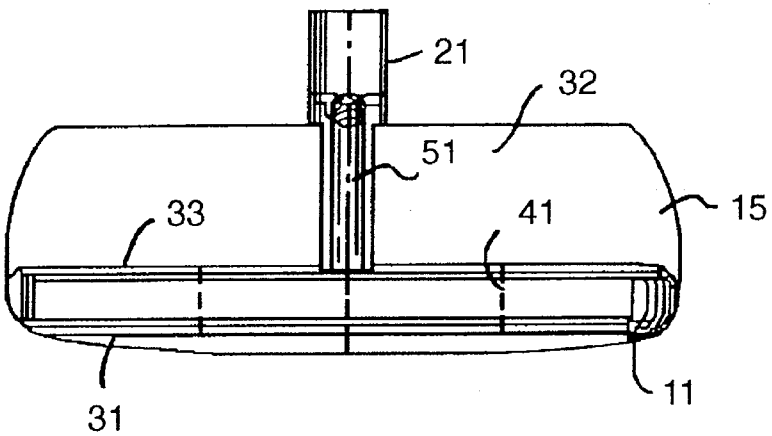
FIG. 4 is a diagrammatic rear front of the putter head of FIG. 2.
Figure 5:
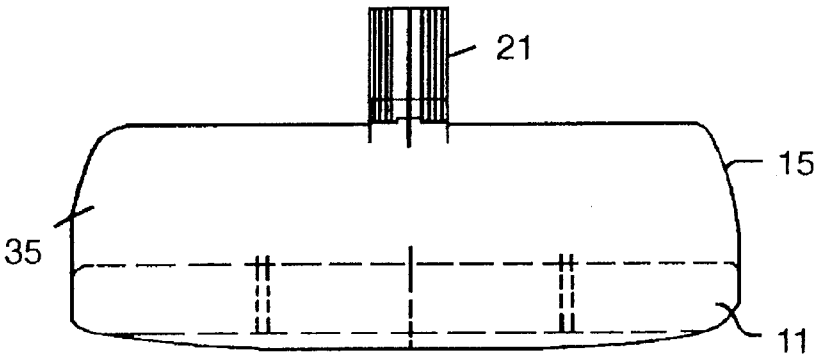
FIG. 5 is a diagrammatic front view of the putter head of FIG. 2.

With attention directed to FIGS. 2–8 of the drawings, a non-limiting example of a golf club head, in particular, a putter head, that has been fitted with the golf ball extracting device of the present invention is diagrammatically illustrated at 10, as having a generally flat base 11 of a prescribed thickness 13, that extends from and is solid with a generally vertical body portion 15 of thickness 17. In the non-limiting example of the illustrated embodiment, the putter head base 11 is shown as being generally semicircular. Such a shape is advantageous in that it provides symmetry relative to the center, ball-striking area of the putter head face and thereby balance to the putting stroke; in addition, the semicircular shape allows the putter to be readily inserted into a putting cup on the putting green. However, it is to be understood that the present invention is not limited to use with only this or any other putter head shape. Putter head 10 is made of a conventional material used in golf clubs, such as metal, and has a shank portion 21 that is integrally formed with the vertical body portion 15, so that the putter head may be attached to the lower end of a putter shaft shown at 25. For this purpose, shank portion 21 may have a threaded bore 29, that is sized to accommodate corresponding threads of the shaft 25.

The generally semi-circularly shaped flat base 11 has a flat bottom surface 31 and a similar top surface 33 parallel to flat bottom surface 31, that intersects a rear face 32 of generally vertical body portion 15. Body portion 15 has a generally flat and smooth front 'putting' face 35, which is generally flush with the outer surface of the shank portion 21, so as to present a continuously flat striking surface to a golf ball being putted.

Figure 6:
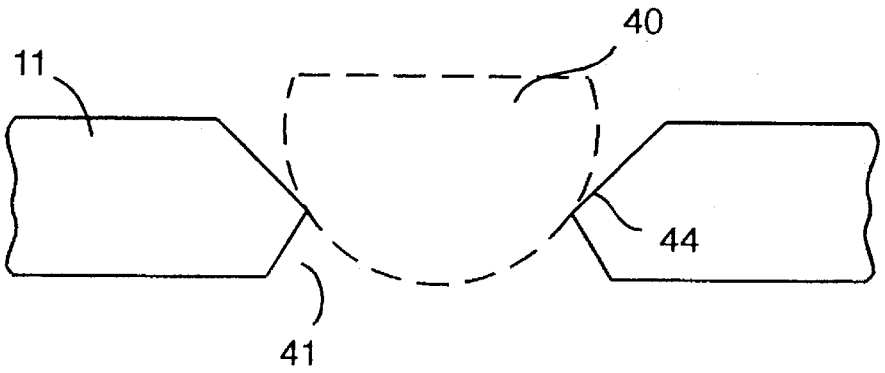
FIG. 6 diagrammatically shows the manner in which the interior wall of a putter head aperture may be tapered to a diameter slightly less than that of a standard golf ball.

In accordance with the present invention, the putter head base 11 is provided with a generally cylindrically shaped aperture 41, which extends through its thickness 13 from top surface 33 to bottom surface 31. As shown in FIG. 6, the interior wall of the aperture 41 may be tapered to a ridge surface region 44 of a diameter slightly less than that of a standard golf ball 40, so that the flexible cover of the golf ball must flex or be slightly compressed in the radial direction, in order to pass a golf ball through the aperture. The reduced diameter ridge surface region 44 thereby provides a circular 'at rest' stop against movement of the ball back through the aperture.

Figure 7:
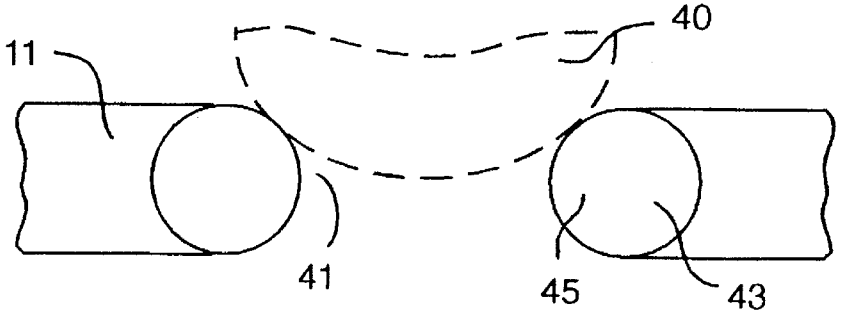
FIG. 7 is a cross-sectional view of a putter head base shown an aperture provided with a generally concave region contoured to receive and capture a generally circular, flexible ring.
Figure 8:
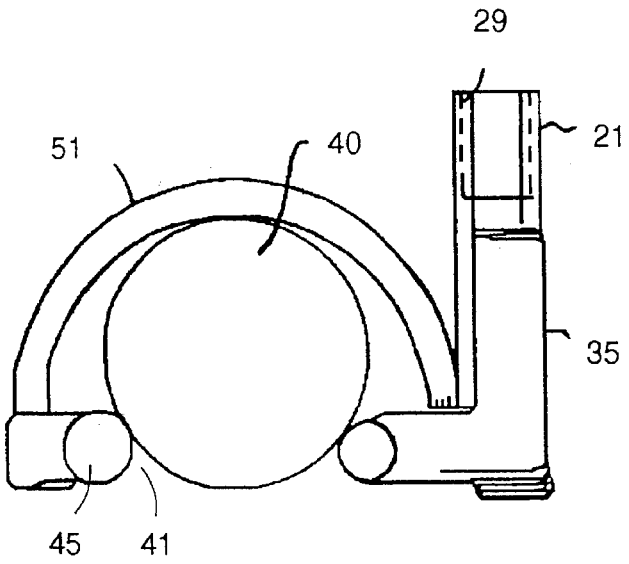
FIG. 8 diagrammatically illustrates a golf ball captured in a confinement volume above the putter head base aperture.

Alternatively, as shown in the detailed cross-sectional view of FIG. 7, aperture 41 may be provided with a generally concave region 43 that is contoured so as to receive and capture a generally circular, flexible ring 45 of elastically deformable material, such as a rigid polymer, or the like. Similar to ridge 44 of the aperture embodiment of FIG. 6, flexible ring 45 has an inner diameter that is slightly smaller than that of a golf ball, so that the ring must flex slightly in order to allow a golf ball 40 to pass through it. For a standard golf ball, the inner diameter of the ridge and the flexible ring may be on the order of $1\frac{21}{23}$ inches.

Affixed to the top surface 33 of base 11 and extending over aperture 41 is a ball movement-restricting and retaining element 51, such as a semicircular retaining ring, opposite ends 53 and 55 of which may be welded to spaced apart regions 57 and 59, respectively, of the top surface 33 of the base, as shown. As diagrammatically illustrated in FIG. 8, semicircular retaining ring 51 is shaped and sized to encompass a golf ball capture or confinement volume above aperture 41, that is sufficient to allow a golf ball to pass through the aperture, but then be restricted from further substantial movement by the combination of the reduced inner diameter of the ridge 44 or flexible ring 45 and retaining element 51.

Thus, by gripping the handle of the putter, the golfer places the putting head such that the aperture 41 in the base 11 is directly over the ball. The golfer then pushes the club downwardly, so that the ball passes upwardly through the aperture 41 and exits the aperture at the top surface 33 of the putter head base 11. The retaining element 51 then cooperates with the reduced inner diameter of ridge 44 or flexible ring 45 in aperture 41, to retain the golf ball in a captured condition on the top surface side of the base of the putter head. Since the flexible ring has an inner diameter that is slightly smaller than that of the golf ball, then once the flexible ring flexed to allow the golf ball to pass upwardly through the aperture, the flexible ring then returns to its previous shape that prevents the golf ball from dropping back out through the aperture.

To remove the ball from this captured condition, the golfer may use one or more fingers to simply push downward on the ball from the top side 33 of the putter head base 11, forcing the flexible ring 45 to again expand slightly, and thereby the ball to pass through aperture 41 to the bottom surface 31 of the base 11 and into the golfer's hand.

Figure 9:
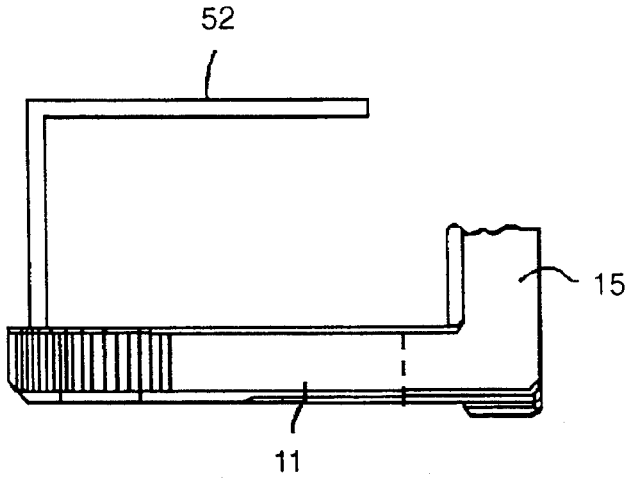
FIG. 9 diagrammatically illustrates a putter base provided with an L-shaped retaining tine.

It should be observed that the semicircular configuration of retaining element 51 is given as a non-limiting example. Other configurations such as that of an L-shaped tine or finger element, and similar 'backstop' type elements, diagrammatically illustrated at 52 in FIG. 9 are also possible. What is important is that the size and shape of the retaining element allow a golf ball to pass completely through aperture 41 and its flexible ring 45 from the bottom surface 31 of base 11, without allowing substantial further movement and, as described above, cooperates with the reduced inner diameter of flexible ring 45, so as to retain the golf ball in a captured condition on the top surface side of the putter head base. Such an 'abbreviated cage' shape of the retaining element 51 facilitates a golfer's use of one or more fingers to push downward on the ball from the top side of the putter head and thereby force the ball through flexible ring to the bottom surface of the base.

As will be appreciated from the foregoing description, the present invention incorporates ball-seizure functionality similar to that employed in my above-described patented handle-mounted device, by modifying the head of a golf club, such as a putter head, so that the golf club head itself includes a golf ball seizing aperture. This aperture cooperates with an associated retaining element, so that a golf ball can be easily retrieved and captured at the club head, simply by the golfer holding the club by its handle, rather than inverting the club.

While I have shown and described several embodiments in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A golf ball retrieving device comprising a golf club head having an aperture therethrough, said aperture having an effective interior diameter that allows passage of a golf ball therethrough by relative flexible movement between an interior surface of said aperture and an outer surface of said golf ball, and a retaining element mounted adjacent to said aperture such that, upon passing through said aperture, said golf ball is restricted from further substantial movement and thereby captured in a confinement volume by the combination of said effective interior diameter of said aperture and said retaining element, and wherein said aperture is a generally cylindrically shaped aperture, and is tapered to a ridge surface region of a diameter slightly less than that of said golf ball, so that, in the course of passing through said aperture, said outer surface of said golf ball flexes in the radial direction, in order to allow said golf ball to pass through said aperture, whereby said ridge surface region provides a circular 'at rest' stop, preventing said golf ball from dropping back through said aperture.

2. A golf ball retrieving device according to claim 1, wherein said golf club head comprises a putter head having a base portion that extends from a generally vertical body portion on which a putting face of said putter is provided, said base portion having top and bottom surfaces, with said aperture passing through said base portion between said top and bottom surfaces thereof, and wherein said retaining element is affixed to said putter head so as to extend over said aperture.

3. A golf ball retrieving device according to claim 2, wherein said base portion of said putter head is integrally formed with said vertical body portion and has generally semicircular flat top and bottom surfaces, with said aperture passing through said base portion between said top and bottom surfaces thereof, and wherein said retaining element is affixed to said top surface of said putter head so as to extend over said aperture.

4. A golf ball retrieving device according to claim 3, wherein said retaining element comprises a generally semicircular retaining ring having opposite ends thereof affixed to spaced apart regions of said top surface of said base portion of said putter head.

5. A golf ball retrieving device according to claim 1, wherein said retaining element is generally ring-shaped.

6. A golf ball retrieving device according to claim 1, wherein said retaining element includes a generally L-shaped member.

7. A golf ball retrieving device comprising a golf club head having an aperture therethrough, said aperture having an effective interior diameter that allows passage of a golf ball therethrough by relative flexible movement between an interior surface of said aperture and an outer surface of said golf ball, and a retaining element mounted adjacent to said aperture such that, upon passing through said aperture, said golf ball is restricted from further substantial movement and thereby captured in a confinement volume by the combination of said effective interior diameter of said aperture and said retaining element, and further including a flexible ring retained in said aperture, said flexible ring having an inner diameter that is slightly smaller than that of said golf ball, so that said flexible ring flexes as said golf ball passes through said aperture, and then returns to a shape that prevents said golf ball from dropping back through said aperture.

8. A golf ball retrieving device comprising a golf club head having an aperture therethrough, said aperture having an effective interior diameter that allows passage of a golf ball therethrough by relative flexible movement between an interior surface of said aperture and an outer surface of said golf ball, and a retaining element mounted adjacent to said aperture such that, upon passing through said aperture, said golf ball is restricted from further substantial movement and thereby captured in a confinement volume by the combination of said effective interior diameter of said aperture and said retaining element, and wherein said aperture has a generally concave region that is contoured so as to receive and capture a generally circular, flexible ring of elastically deformable material, said flexible ring having an inner diameter that is slightly smaller than that of said golf ball, so that said flexible ring must be flexed slightly, in order to allow said golf ball to pass through said aperture.

9. A golf club having a shaft, a handle at one end of said shaft, a club head at another end of said shaft, and a ball retrieving device incorporated into said club head and comprising an aperture passing through said club head, said aperture having an effective interior diameter that allows passage of a golf ball through said aperture by relative flexible movement between an interior surface of said aperture and an outer surface of said golf ball, and a retaining element mounted on said club head adjacent to said aperture such that said golf ball, upon passing through said aperture, is restricted from further substantial movement and is thereby effectively captured in a confinement volume by the combination of said effective interior diameter of said aperture and said retaining element, and wherein said aperture is a generally cylindrically shaped aperture, and is tapered to a ridge surface region of a diameter slightly less than that of said golf ball, so that, in the course of passing through said aperture, said outer surface of said golf ball flexes in the radial direction, in order to allow said golf ball to pass through said aperture, whereby said ridge surface region provides a circular 'at rest' stop, preventing said golf ball from dropping back through said aperture.

10. A golf club according to claim 9, wherein said golf club head comprises a putter head having a base portion that extends from a generally vertical body portion on which a putting face of said putter is provided, said base portion having top and bottom surfaces, with said aperture passing through said base portion between said top and bottom surfaces thereof, and wherein said retaining element is affixed to said putter head so as to extend above said aperture.

11. A golf club according to claim 10, wherein said base portion of said putter head is integrally formed with said vertical body portion and has generally semicircular flat top and bottom surfaces, with said aperture passing through said base portion between said top and bottom surfaces thereof, and wherein said retaining element is affixed to said top surface of said putter head so as to extend over said aperture.

12. A golf club according to claim 11, wherein said retaining element comprises a generally semicircular retaining ring having opposite ends thereof affixed to spaced apart regions of said top surface of said base portion of said putter head.

13. A golf club according to claim 9, wherein said retaining element is generally ring-shaped.

14. A golf club according to claim 9, wherein said retaining element includes a generally L-shaped member.

15. A golf club comprising a shaft, a handle at one end of said shaft, a club head at another end of said shaft, and a ball retrieving device incorporated into said club head and comprising an aperture passing through said club head, said aperture having an effective interior diameter that allows passage of a golf ball through said aperture by relative flexible movement between an interior surface of said aperture and an outer surface of said golf ball, and a retaining element mounted on said club head adjacent to said aperture such that said golfball, upon passing through said aperture, is restricted from further substantial movement and is thereby effectively captured in a confinement volume by the combination of said effective interior diameter of said aperture and said retaining element, and further including a flexible ring retained in said aperture, said flexible ring having an inner diameter that is slightly smaller than that of said golf ball, so that said flexible ring flexes as said golf ball passes through said aperture, and then returns to a shape that prevents said golf ball from dropping back through said aperture.

16. A golf club comprising a shaft, a handle at one end of said shaft, a club head at another end of said shaft, and a ball retrieving device incorporated into said club head and comprising an aperture passing through said club head, said aperture having an effective interior diameter that allows passage of a golf ball through said aperture by relative flexible movement between an interior surface of said aperture and an outer surface of said golf ball, and a retaining element mounted on said club head adjacent to said aperture such that said golf ball, upon passing through said aperture, is restricted from further substantial movement and is thereby effectively captured in a confinement volume by the combination of said effective interior diameter of said aperture and said retaining element, and wherein said aperture has a generally concave region that is contoured so as to receive and capture a generally circular, flexible ring of elastically deformable material, said flexible ring having an inner diameter that is slightly smaller than that of said golf ball, so that said flexible ring must be flexed slightly, in order to allow said golf ball to pass through said aperture.

* * * * *